US008915575B1

(12) United States Patent
Kasiske, Jr. et al.

(10) Patent No.: US 8,915,575 B1
(45) Date of Patent: Dec. 23, 2014

(54) STAGGERED PRINTHEAD PRINTER WITH CONTOURED MEDIA GUIDE

(71) Applicants: W. Charles Kasiske, Jr., Webster, NY (US); Michael Joseph Piatt, Dayton, OH (US); Christopher M. Muir, Rochester, NY (US); John Leonard Hryhorenko, Webster, NY (US)

(72) Inventors: W. Charles Kasiske, Jr., Webster, NY (US); Michael Joseph Piatt, Dayton, OH (US); Christopher M. Muir, Rochester, NY (US); John Leonard Hryhorenko, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/923,407

(22) Filed: Jun. 21, 2013

(51) Int. Cl.
*B41J 2/155* (2006.01)
*B41J 2/01* (2006.01)

(52) U.S. Cl.
CPC ..... *B41J 2/155* (2013.01)
USPC ..... 347/42; 347/104

(58) Field of Classification Search
None
See application file for complete search history.

(56) References Cited

U.S. PATENT DOCUMENTS 8,087,773 B2 * 1/2012 Bober et al. ..... 347/104
2012/0286468 A1 * 11/2012 Ui ..... 271/228

* cited by examiner

*Primary Examiner* — Lisa M Solomon
(74) *Attorney, Agent, or Firm* — Kevin F. Spaulding

(57) ABSTRACT

A printing system including a staggered inkjet printhead including at least two inkjet nozzle arrays arranged along first and second print lines in an alternating pattern, wherein the inkjet nozzle arrays along a particular print line alternate with non-printing regions. A media guide including first and second media guide surfaces is used for guiding receiver media along a media path past the first and second print lines of the inkjet printhead. At least one of the media guide surfaces is contoured such that it is closer to the staggered inkjet printhead along portions of the associated print line that correspond to the associated inkjet nozzle arrays than it is for at least some portion of the associated print line that corresponds to the non-printing regions.

18 Claims, 19 Drawing Sheets

STAGGERED PRINTHEAD PRINTER WITH CONTOURED MEDIA GUIDE

CROSS-REFERENCE TO RELATED APPLICATIONS

Reference is made to commonly assigned, co-pending U.S. patent application Ser. No. 13/923,403, filed concurrently herewith, entitled "Inkjet printing system with contoured media guide" by Kasiske et al.; and to commonly assigned, co-pending U.S. patent application Ser. No. 13/923,410, filed concurrently herewith, entitled "Inkjet printer with contoured media guide roller" by Kasiske et al., the disclosures of which are incorporated herein by reference.

FIELD OF THE INVENTION

This invention pertains to the field of inkjet printing and more particularly to an apparatus for guiding a receiver media past inkjet printheads.

BACKGROUND OF THE INVENTION

In a digitally controlled inkjet printing system, a receiver media (also called a print medium herein) is directed through a series of components. The receiver media can be a cut sheet of media or a continuous web of media. A web or cut sheet transport system physically moves the receiver media through the printing system. As the receiver media moves through the printing system, liquid (e.g., ink), is applied to the receiver media by one or more printheads through a process commonly referred to as jetting of the liquid. The jetting of liquid onto the receiver media introduces significant moisture content to the receiver media, particularly when the system is used to print multiple colors on a receiver media. Due to the added moisture content, an absorbent receiver media expands and contracts in a non-isotropic manner, often with significant hysteresis. The continual change of dimensional characteristics of the receiver media can adversely affect image quality. Although drying is used to remove moisture from the receiver media, drying can also cause changes in the dimensional characteristics of the receiver media that can adversely affect image quality.

FIG. 1 illustrates a type of distortion of a receiver media 3 that can occur during an inkjet printing process. As the receiver media 3 absorbs the water-based inks applied to it, the receiver media 3 tends to expand. When the direction of expansion is in a direction that is perpendicular to a media advance direction 4, it is referred to as expansion in the cross-track direction 7. Typically, the contact of the receiver media 3 with rollers 2 (or other components) in the inkjet printing system produces sufficient friction between the receiver media 3 and contact surface 8 that the receiver media 3 is not free to slide in the cross-track direction 7, even though the receiver media 3 is beginning to expand in that direction. This can result in localized buckling of the receiver media 3 away from the rollers 2 to create lengthwise flutes 5, also called ripples or wrinkles, in the receiver media 3. Wrinkling of the receiver media 3 during the printing process can lead to permanent creases in the receiver media 3 which adversely affects image quality.

Inkjet printheads are typically located and aligned over the receiver media 3 by a support structure. In some such systems, the support structure locates multiple printhead modules in two or more rows; the rows being substantially parallel to each other and aligned with the cross-track direction. To prevent the receiver media 3 from vibrating up and down in the print zone, the receiver media 3 is supported by a media guide surface that is aligned with the print line of each row of printheads. It is not uncommon for the bottom face of the support structure to become wet, for example due to condensation from the moist air produced by the printing process.

It has been found that under some printing conditions the flutes 5 in the receiver media 3 can be sufficiently tall that the top of the flutes 5 can contact the bottom surface of the support structure of the printhead. When this occurs, the printed ink on the flutes 5 can be smeared by the contact. Additionally, the moisture on the bottom of the support structure can be transferred to the receiver media 3. The result is a degradation of the print quality. As such, there is an ongoing need to provide inkjet printing systems and processes with the ability to effectively handle receiver media expansion associated with the absorption of water by the receiver media 3 in order to prevent the receiver media 3 from contacting the support structure so that good print quality can be maintained.

SUMMARY OF THE INVENTION

The present invention represents a printing system comprising:

a staggered inkjet printhead including at least two inkjet nozzle arrays arranged along first and second print lines in an alternating pattern, the first and second print lines being parallel to each other and separated from each other along a media advance direction, each inkjet nozzle array including a corresponding group of nozzles extending along the corresponding print line in a nozzle array direction, the nozzles being adapted to eject drops of ink onto a receiver media which is moved along a media path past the first print line and then past the second print line, wherein the inkjet nozzle arrays along a particular print line alternate with non-printing regions, the positions of the inkjet nozzles arrays along the first and second print lines being offset from each other such that the non-printing regions along one of the print lines are aligned with the inkjet nozzle arrays along the other of the print lines; and a media guide including:

a first media guide surface for guiding the recording media along the media path past the first print line of the staggered inkjet printhead; and a second media guide surface for guiding the recording media along the media path past the second print line of the staggered inkjet printhead;

wherein at least one of the media guide surfaces is contoured such that it is closer to the staggered inkjet printhead along portions of the associated print line that correspond to the associated inkjet nozzle arrays than it is for at least some portion of the associated print line that corresponds to the non-printing regions.

This invention has the advantage that the contoured media guide surface provides extra relief between the inkjet printhead and the media guide in non-printing regions to reduce the likelihood that flutes in the receiver media come into contact with the inkjet printhead.

It has the additional advantage that the smaller contact surface between the receiver media and the contoured media guide surface allows a greater degree of unconstrained media expansion, thereby reducing the size and number of flutes that are formed in the receiver media.

It has the further advantage that the larger spacing between receiver media and contoured media guide surface in the non-printing regions allows for greater airflow between the inkjet printhead and the receiver media, thereby removing moisture more effectively and reducing the tendency for moisture to condense on support structure.

Figure 1:
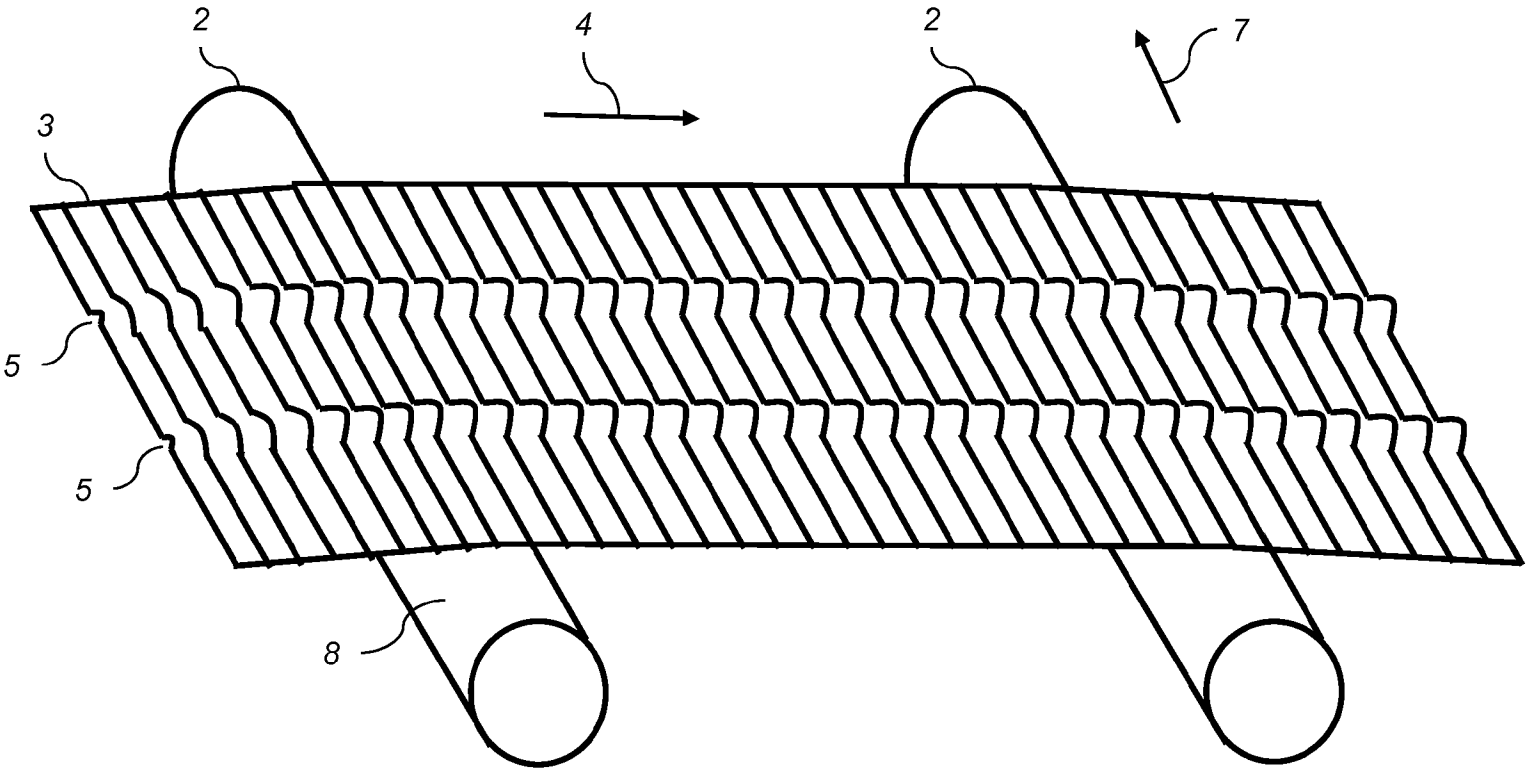
FIG. 1 (Prior Art)
FIG. 1 illustrates the formation of flutes in a continuous web of receiver media due to cross-track expansion of the receiver media.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard and corrugated cardboard can comprise the receiver media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a receiver media. Typically, one of two types of ink jetting mechanisms are used and are categorized by technology as either drop-on-demand inkjet or continuous inkjet.

Drop-on-demand ink jet printing, provides ink drops that impact upon a recording surface using a pressurization actuator, for example, a thermal, piezoelectric or electrostatic actuator. One commonly practiced drop-on-demand inkjet type uses thermal energy to eject ink drops from a nozzle. A heater, located at or near the nozzle, heats the ink sufficiently to form a vapor bubble that creates enough internal pressure to eject an ink drop. This form of inkjet is commonly termed "thermal ink jet." A second commonly practiced drop-on-demand inkjet type uses piezoelectric actuators to change the volume of an ink chamber to eject an ink drop.

The second technology commonly referred to as "continuous" ink jet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous inkjet printing type uses thermal stimulation of the liquid jet with a heater to form drops that eventually become print drops and non-print drops. Printing occurs by selectively deflecting either the print drops or the non-print drops and catching the non-print drops using catchers. Various approaches for selectively deflecting drops have been developed including electrostatic deflection, air deflection, and thermal deflection.

There are typically two types of receiver media used with inkjet printing systems. The first type of receiver media is in the form of a continuous web, while the second type of receiver media is in the form of one or more cut sheets. The continuous web of receiver media refers to a continuous strip of media, generally originating from a source roll. The continuous web of receiver media is moved relative to the inkjet printing system components via a web transport system, which typically include drive rollers, web guide rollers, and web tension sensors. Cut sheets refer to individual sheets of receiver media that are moved relative to the inkjet printing system components via rollers and drive wheels or via a conveyor belt system that is routed through the inkjet printing system.

The invention described herein is applicable to both drop-on-demand and continuous inkjet printing technologies. As such, the term "printhead" as used herein is intended to be generic and not specific to either technology. Additionally, the invention described herein is applicable to both continuous web and cut sheet receiver media. As such, the term receiver media, as used herein, is intended to be generic and not as specific to either type of receiver media or the way in which the receiver media is moved through the printing system.

The terms "upstream" and "downstream" are terms of art referring to relative positions along the transport path of the receiver media; points on the receiver media move along the transport path from upstream to downstream.

Figure 2:
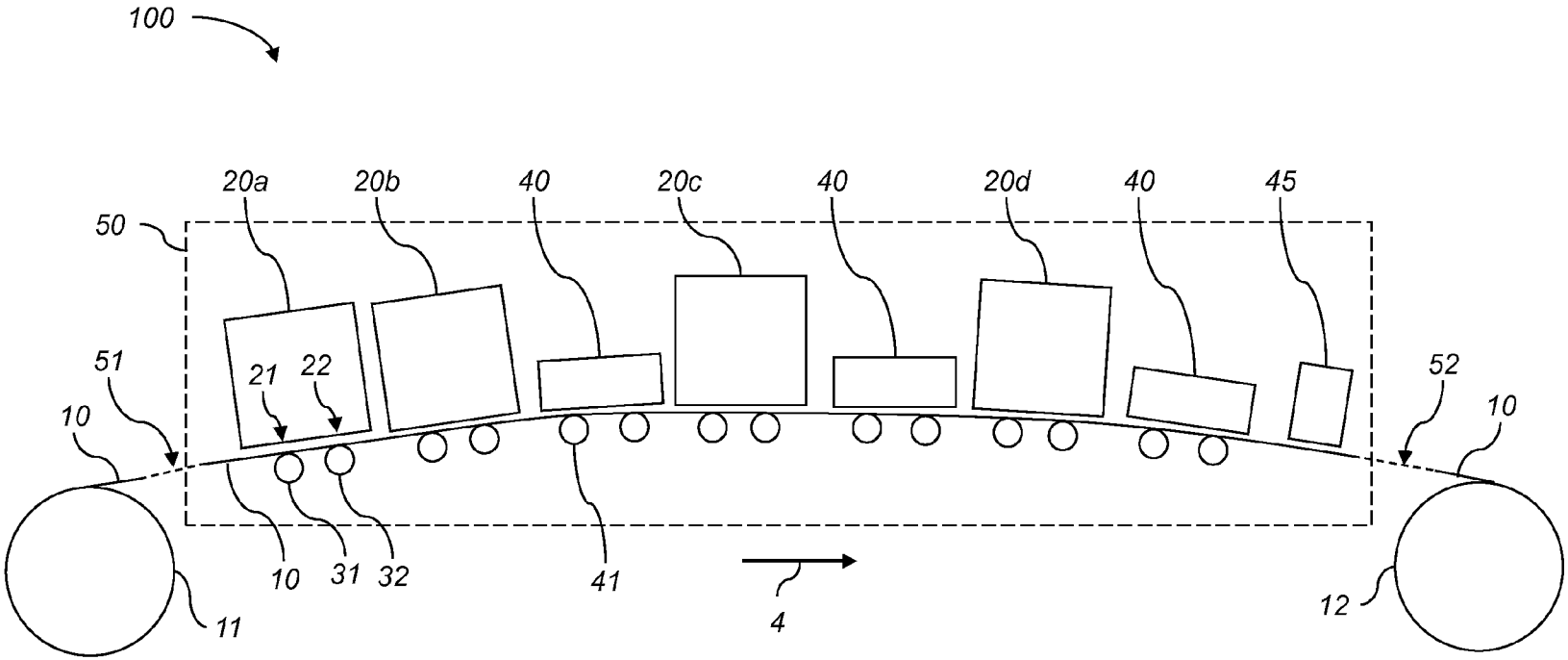
FIG. 2 is a simplified side view of an inkjet printing system for use in the present invention.

Referring to FIG. 2, there is shown a simplified side view of a portion of an inkjet printing system 100 for printing on a first side of a continuous web of receiver media 10. The digital printing system 100 includes a printing module 50 which includes printheads 20*a*, 20*b*, 20*c*, 20*d*, dryers 40, and a quality control sensor 45. In this exemplary system, the first printhead 20*a* jets cyan ink, the second printhead 20*b* jets magenta ink, the third printhead 20*c* jets yellow ink, and the fourth printhead 20*d* jets black ink. In this example, below each printhead 20 is a media guide assembly including first and second print line rollers 31 and 32 that guide the continuous web of receiver media 10 past a first print line 21 and a second print line 22 as the receiver media 10 is advanced along a media path in media advance direction 4. (The print lines will be described in more detail with reference to FIGS. 3 and 4.) Below each dryer 40 is at least one dryer roller 41 for controlling the position of the continuous web of receiver media 10 near the dryers 40. Receiver media 10 originates as a source roll 11 of unprinted receiver media 10 and ends up as a take-up roll 12 of printed receiver media 10. Other details of the printing module 50 and the printing system 100 are not shown in FIG. 2 for simplicity. For example, to the left of printing module 50, a first zone 51 (illustrated as a dashed line region in receiver media 10) can include a slack loop, a web tensioning system, an edge guide and other elements that are not shown. To the right of printing module 50, a second zone 52 (illustrated as a dashed line region in receiver media 10) can include a turnover mechanism and a second printing module similar to printing module 50 for printing on a second side of the receiver media 10.

Figure 3:
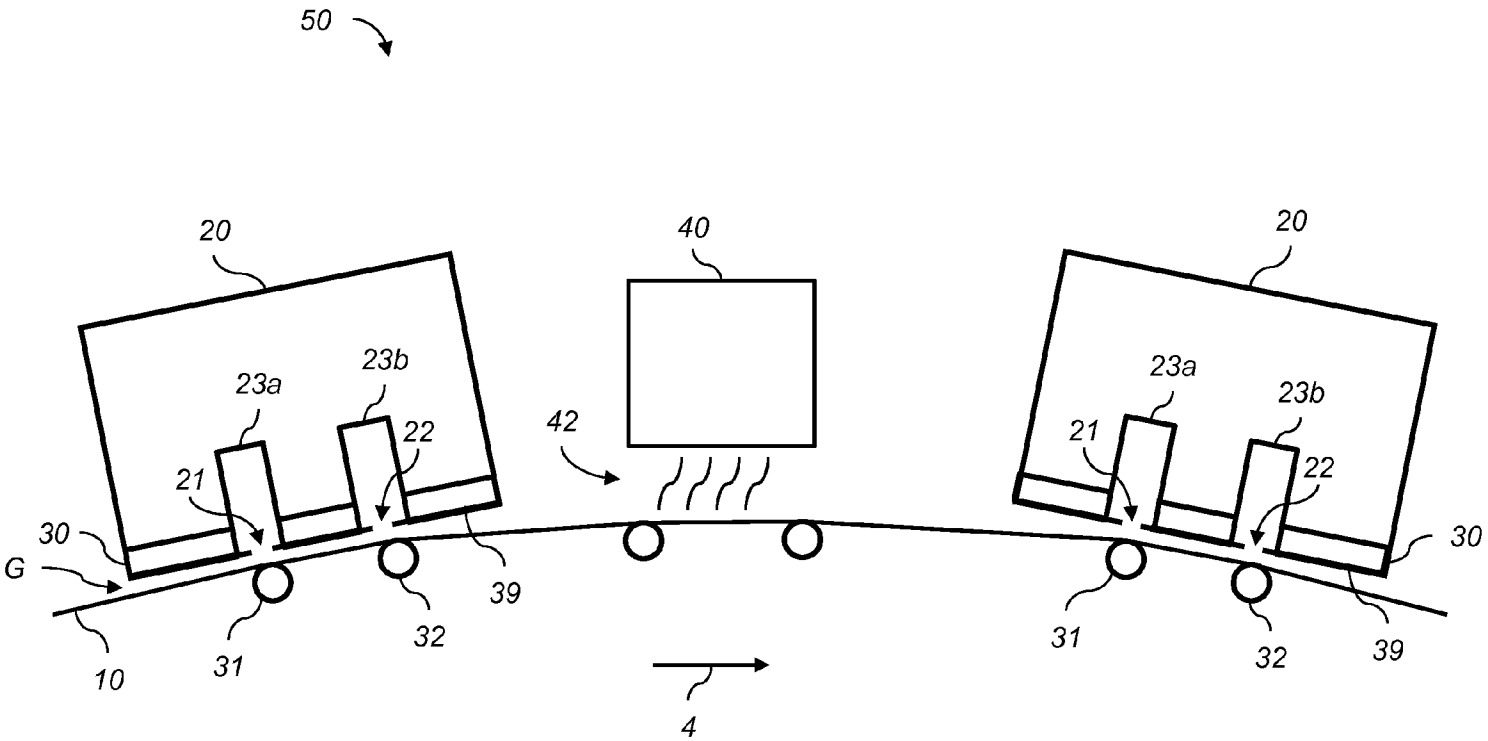
FIG. 3 is a close-up view of a portion of the inkjet printing system of FIG. 2.

Referring to FIG. 3, a portion of the printing module 50 is shown in more detail. As the receiver media 10 is directed through the printing module 50, printheads 20, which typically include two (or more) printhead modules 23*a*, 23*b* having a staggered array of nozzle arrays (see FIG. 4) that eject drops of ink (or other liquid) along corresponding print lines 21, 22. The printhead modules 23*a* and 23*b* within the printhead 20 are located and aligned by a support structure 30 having a support structure surface 39 facing the receiver media 10. The print line rollers 31, 32 are typically aligned with the print lines 21, 22 and serve to guide the receiver media 10 as it is advanced along the media path in the media advance direction 4.

As the ink applied to the receiver media 10 dries by evaporation, assisted by heat 42 from dryer 40, the humidity of the air above the receiver media 10 rises in the clearance gap G between the printer components (for example, printheads 20 and dryers 40) and the receiver media 10. To simplify the description, terms such as moisture, humid, humidity, and dew point that in a proper sense relate only to water in either a liquid or gaseous form, are used to refer to the corresponding liquid or gaseous phases of the solvents that make up a large portion of the inks and other coating fluids applied by the printheads 20. When the ink or other coating fluid is based on a solvent other than water, these terms are intended to refer to the liquid and gaseous forms of such solvents in a corresponding manner.

Figure 4:
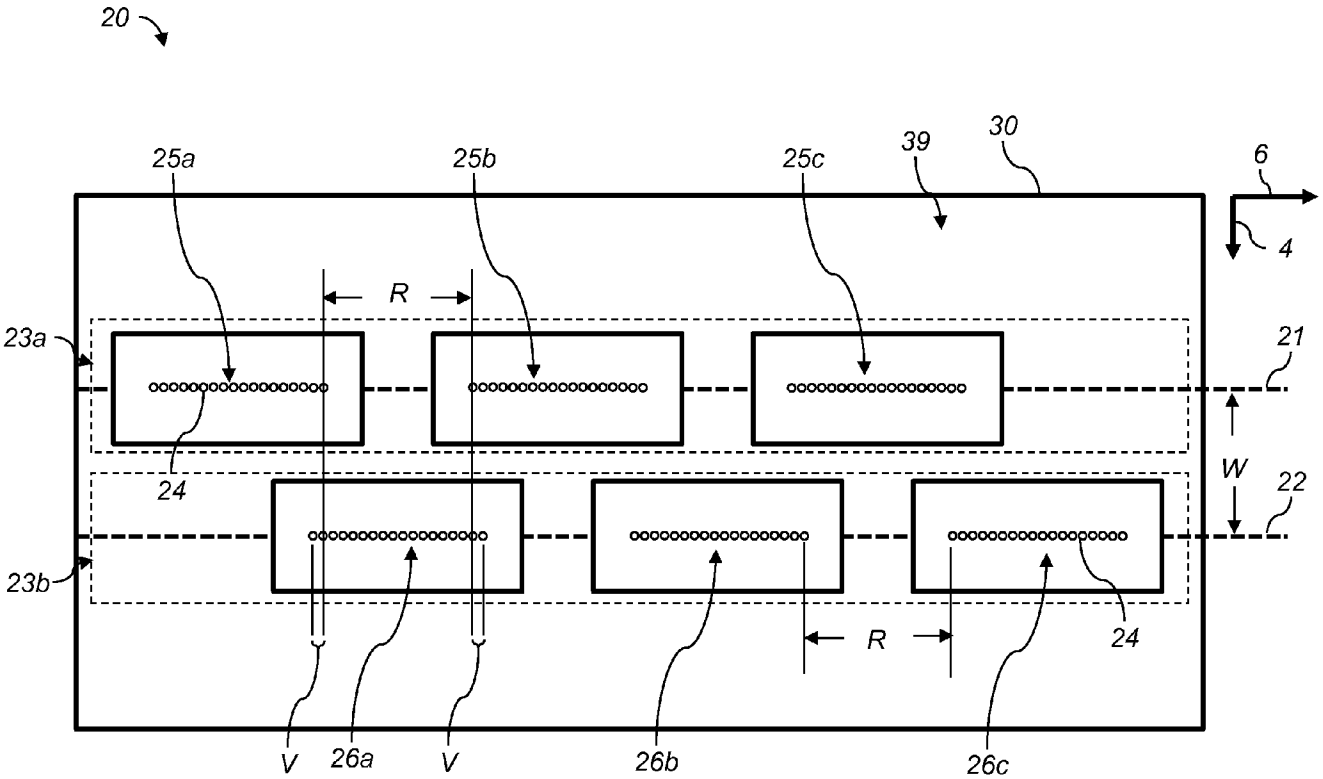
FIG. 4 shows a face of a staggered inkjet printhead.

Referring to FIG. 4, the support structure surface 39 of the support structure 30 of printhead 20 is shown. In this example, printhead 20 includes first printhead module 23*a* having three inkjet nozzle arrays 25*a*, 25*b*, 25*c* arranged along a first print line 21 and second printhead module 23*b* having three inkjet nozzle arrays 26*a*, 26*b*, 26*c* arranged along second print line 22. Each inkjet nozzle array 25*a*, 25*b*, 25*c*, 26*a*, 26*b*, 26*c* includes an array of nozzles 24 adapted to eject drops of ink (not shown) onto portions of a receiver media such as receiver media 10 (FIG. 3). The print lines 21, 22 extend along a nozzle array direction 6 (which is substantially parallel to the cross-track direction 7 shown in FIG. 1). The first and second print lines 21, 22 are substantially parallel and are spaced apart along media advance direction 4 by a separation distance W, which in some embodiments is approximately 6 inches. Within the context of the present disclosure "substantially parallel" means parallel to within about 5°.

The inkjet nozzle arrays 25*a*, 25*b*, 25*c* disposed along the first print line 21 are separated from each other by intervening non-printing regions R. Likewise, the inkjet nozzle arrays 26*a*, 26*b*, 26*c* disposed along the second print line 22 are also separated from each other by intervening non-printing regions R. The printhead modules 23*a*, 23*b* are arranged in a staggered formation such that the non-printing regions R along the first print line 21 are aligned with the inkjet nozzle arrays 26*a*, 26*b*, 26*c* along the second print line 22, and the non-printing regions R along the second print line 22 are aligned with the inkjet nozzle arrays 25*a*, 25*b*, 25*c* along the first print line 21. In this way, the inkjet nozzle arrays 26*a*, 26*b* and 26*c* disposed along second print line 22 are adapted to eject drops of ink (not shown) onto portions of the receiver media 10 that are complementary to the portions that are printed by the inkjet nozzle arrays 25*a*, 25*b*, 25*c* disposed along first print line 21. Inkjet printheads 20 having such a staggered formation including inkjet nozzle arrays 25*a*, 25*b*, 25*c*, 26*a*, 26*b*, 26*c* arranged along first and second print lines 21, 22 in an alternating pattern are sometimes called "staggered inkjet printheads."

The ends of the inkjet nozzle arrays 25*a*, 25*b*, 25*c* along the first print line 21 typically overlap with the ends of the inkjet nozzle arrays 26*a*, 26*b*, 26*c* along the second print line 22 to provide overlap regions V. The overlap regions V enable the printed image from the overlapped inkjet nozzle arrays 25*a*, 25*b*, 25*c*, 26*a*, 26*b*, 26*c* to be stitched together without a visible seam through the use of appropriate stitching algorithms that are known in the art. The length of each inkjet nozzle array 25*a*, 25*b*, 25*c*, 26*a*, 26*b*, 26*c* from one end nozzle to the opposite end nozzle is approximately 4 inches in some embodiments. Overlap regions V are not very large, so that the non-printing regions R between adjacent inkjet nozzle arrays 25*a*, 25*b*, 25*c*, 26*a*, 26*b*, 26*c* in such embodiments is also approximately 4 inches.

In some embodiments, each printhead module 23*a*, 23*b* can include a sub support structure, as well as additional elements such as electronics and ink line connections. For the case of a continuous inkjet printhead, printhead modules 23*a*, 23*b* can also include a catcher to catch non-printing drops of ink.

Figure 5:
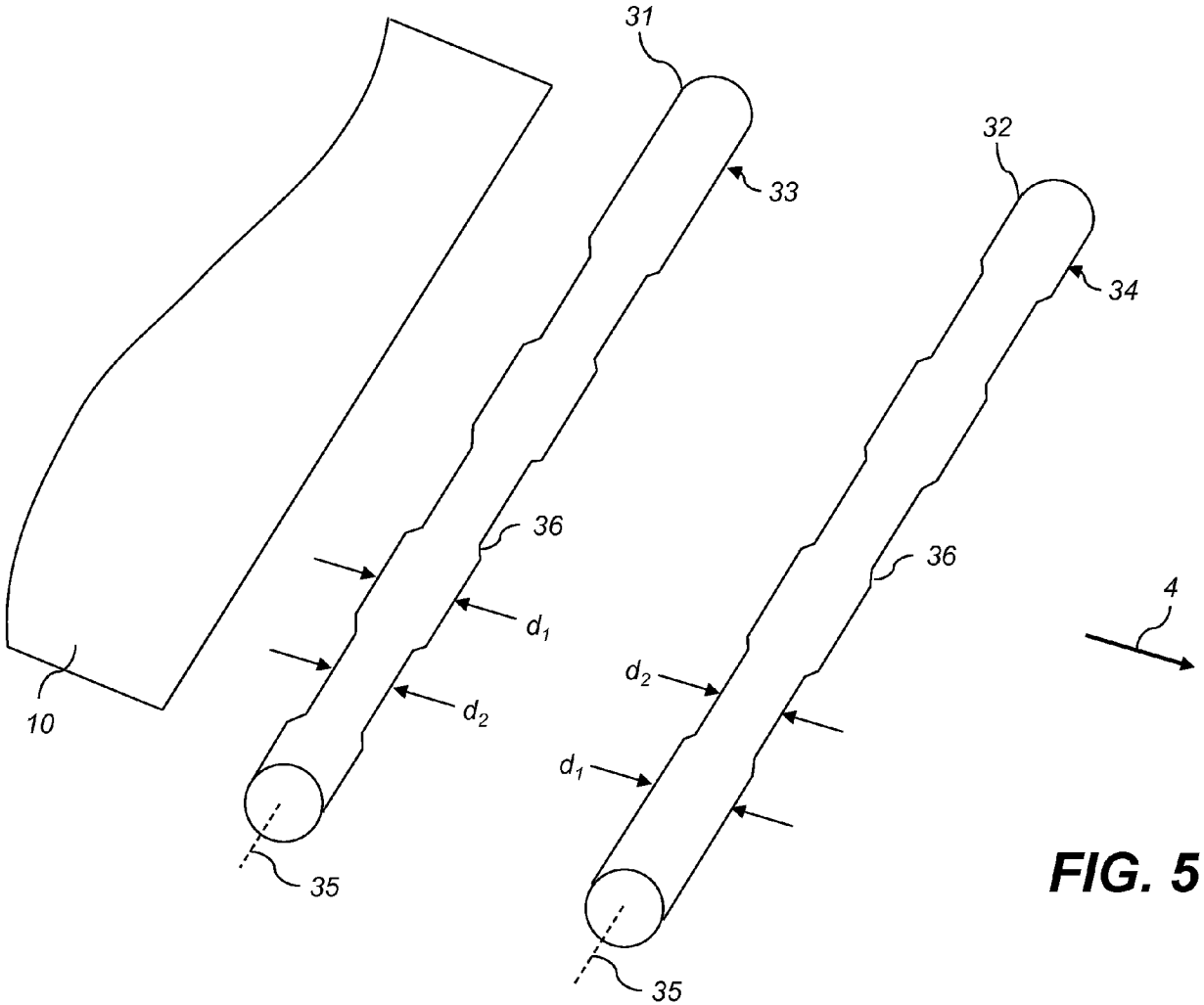
FIG. 5 is a perspective view showing first and second contoured print line rollers providing contoured media guide surfaces according to an embodiment of the invention.

To prevent the receiver media 10 from fluttering or vibrating up and down in the print zones near the print lines 21, 22, the receiver media 10 is supported by a media guide including first print line roller 31 (FIG. 3) that is aligned with first print line 21 and second print line roller 32 (FIG. 3) that is aligned with second print line 22. In various embodiments, the surface of first print line roller 31 provides a first contoured media guide surface 33, and the surface of second print line roller 32 provides a second contoured media guide surface 34 for receiver media 10 as it is advanced along media advance direction 4 as seen in the perspective of FIG. 5. Each of the print line rollers 31, 32 has an axis 35 that is parallel to the first print line 21 and the second print line 22, respectively. The diameter of first print line roller 31 varies along its length to provide the first contoured media guide surface 33 and the diameter of the second print line roller 32 varies along its length to provide the second contoured media guide surface 34.

Figure 6:
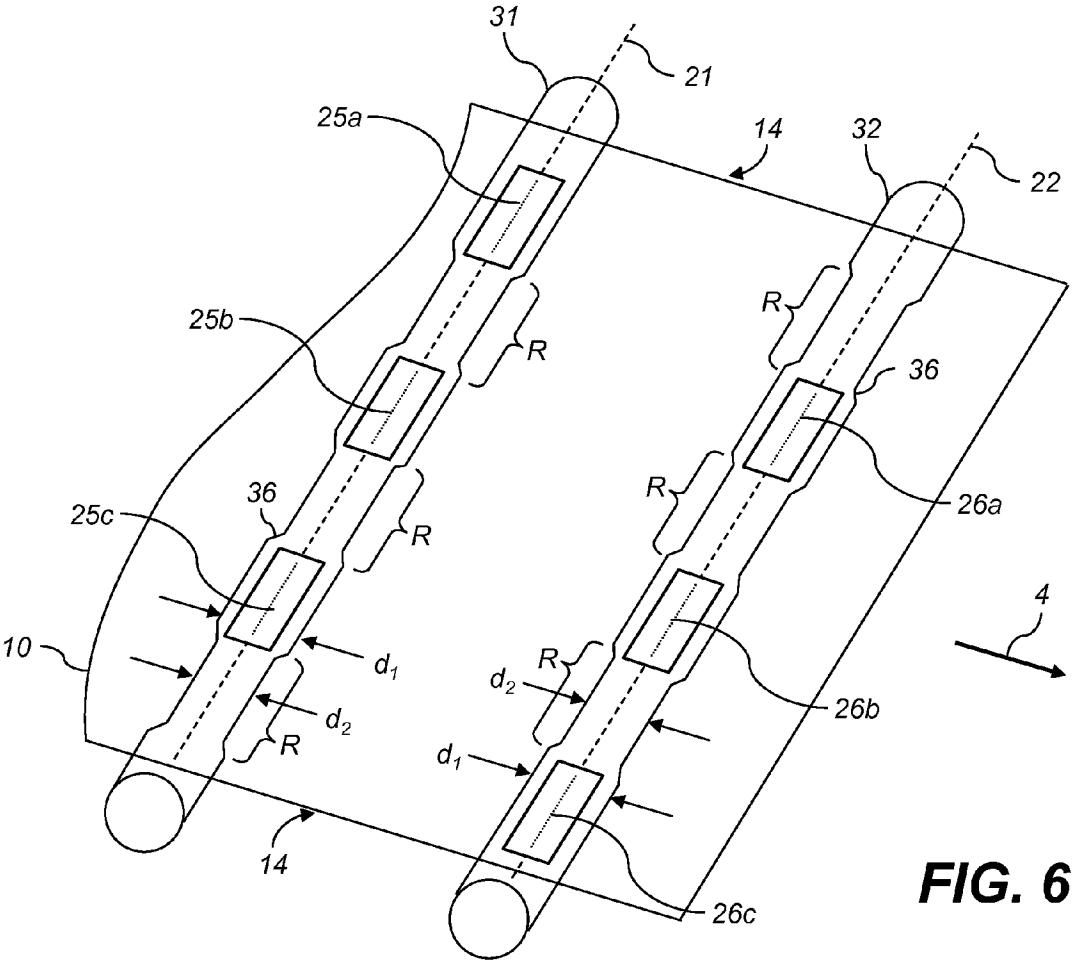
FIG. 6 shows a set of staggered inkjet nozzle arrays positioned over the contoured print line rollers of FIG. 5.

FIG. 6 is similar to FIG. 5, but also shows a portion of the receiver media 10 positioned over the print line rollers 31, 32. FIG. 6 also shows the relative positions of inkjet nozzle arrays 25*a*, 25*b*, 25*c* along first print line 21 and inkjet nozzle arrays 26*a*, 26*b*, 26*c* along second print line 22. To clarify the relative positions in FIG. 6, receiver media 10 is shown as if it were transparent, and support structure 30 (FIG. 4) is hidden.

With reference to FIGS. 5 and 6 it can be seen that the diameter of first print line roller 31 varies between a first larger diameter $d_1$ and a second smaller diameter $d_2$ such that the diameter is larger for portions of the first print line roller 31 that are aligned with the inkjet nozzle arrays 25*a*, 25*b*, 25*c* than it is for at least some portion of the first print line roller 31 that is aligned with the one or more non-printing regions R. Likewise, the diameter of the second print line roller 32 is larger for portions of the second print line roller 32 that are aligned with the inkjet nozzle arrays 26*a*, 26*b*, 26*c* than it is for at least some portion of the second print line roller 32 that is aligned with the one or more non-printing regions R. By "at least some portion of the roller" it is meant that the larger diameter $d_1$ can extend partially into the non-printing regions R.

Figure 7A:
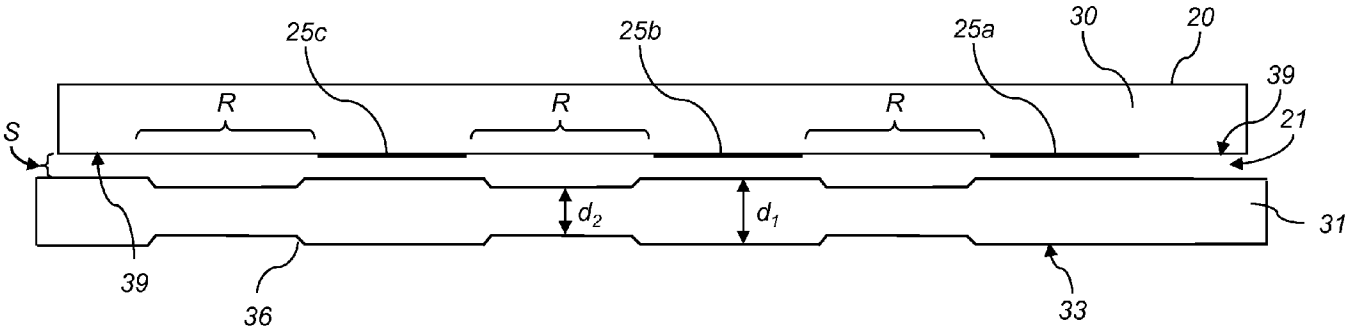
FIGS. 7A and 7B show cross-sectional views through the configuration of FIG. 6 along the first and second print lines, respectively.
Figure 7B:
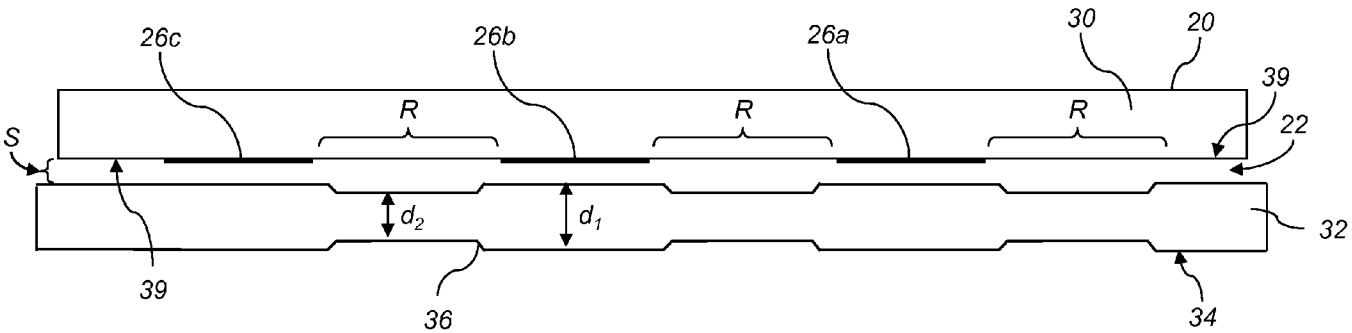

FIG. 7A is a cross-sectional view along print line 21 (also including support structure 30 of FIG. 4, but not including receiver media 10). Similarly FIG. 7B is a cross-sectional view along print line 22. With reference to FIGS. 5, 6, 7A and 7B it can be seen that first contoured media guide surface 33 of first print line roller 31 is contoured such that it is closer to the printhead 20 (including the bottom support structure surface 39 of support structure 30 and inkjet nozzle arrays 25*a*, 25*b*, 25*c*) for portions of print line 21 corresponding to the inkjet nozzle arrays 25*a*, 25*b*, 25*c* than it is for at least some portion of the print line 21 corresponding to the one or more non-printing regions R between the inkjet nozzle arrays 25*a*, 25*b*, 25*c* (and similarly for contoured media guide surface 34 of second print line roller 32 with respect to inkjet nozzle arrays 26*a*, 26*b*, 26*c*). In other words, a spacing S between contoured media guide surface 33 and printhead 20 is smaller near the inkjet nozzle arrays 25*a*, 25*b*, 25*c* than near the non-printing regions R (and similarly for contoured media guide surface 34).

As shown in FIGS. 5, 6 and 7A, the diameter of the first print line roller 31 can gradually taper in transition portion 36 from the first diameter $d_1$ to the second diameter $d_2$ to avoid producing high stress concentration on the receiver media. In the example shown in FIG. 6, the side edges 14 of receiver media 10 are preferably supported by portions of print line rollers 31, 32 having the larger diameter $d_1$.

Figure 8:
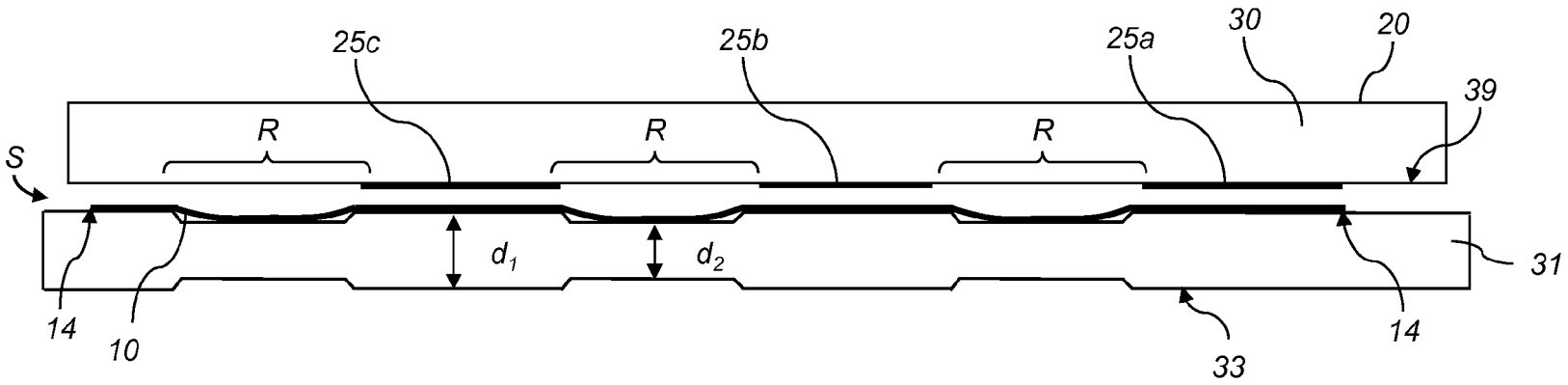
FIG. 8 is a cross-sectional view similar to FIG. 7A, but with the receiver media also shown.

FIG. 8 is a cross-sectional view similar to FIG. 7A, but with receiver media 10 also shown. Because the receiver media 10 (whether plain paper, coated paper, plastic, textile or other flexible media) is flexible, the receiver media 10 will be held flat by first contoured media surface 33 of the first print line roller 31 at a small spacing S (typically about 1.25 mm) from the inkjet nozzle arrays 25*a*, 25*b*, 25*c*, but will sag to a larger spacing S from the non-printing regions R (and similarly for the second contoured media guide surface 34 of the second print line roller 32).

A first advantage of such a contoured media guide surface 33 and the resulting larger spacing S between the printhead 20 and the receiver media 10 near non-printing regions R is that if there are any flutes 5 (see FIG. 1) in the region corresponding to non printing regions R, they will be farther away from printhead 20 and less likely to contact support structure 30. A second advantage of such a contoured media guide surface 33 is that because the contact surface between receiver media 10 and contoured media guide surface 33 has been broken up into segments, thereby allowing some unconstrained media expansion, any flutes 5 that are produced will be lower in height than they would be for a flat contact surface 8 as shown in FIG. 1. This means that even in the printing regions near the inkjet nozzle arrays 25*a*, 25*b*, 25*c* the flutes 5 are less likely to contact the printhead 20. A third advantage (discussed in greater detail below) is that the larger spacing between receiver media 10 and support structure 30 allows greater airflow for reducing humidity near support structure 30, thereby reducing the tendency for moisture to condense on support structure 30.

Figure 9:
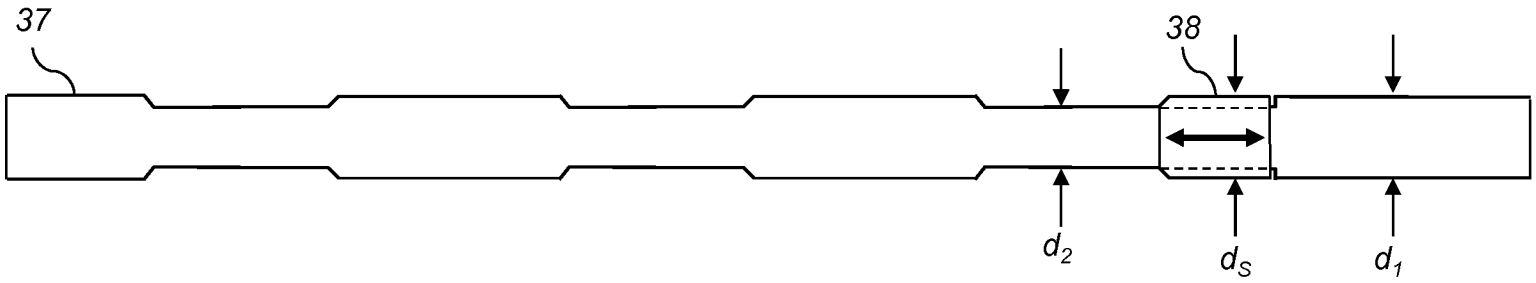
FIG. 9 shows an embodiment of a contoured roller having a sleeve that can be repositioned for different media widths.

An additional desirable feature of the contoured media guide surfaces 33, 34 shown in FIGS. 6 and 8 is that the side edges 14 of the receiver media 10 are supported by portions of first print line rollers 31, 32 having the first larger diameter $d_1$. For receiver media 10 having a sufficiently large width, as in FIGS. 6 and 8, both of the side edges 14 are supported by portions having the first diameter $d_1$ for both print line rollers 31, 32. However, some printing jobs can require printing on 1 narrower receiver media 10, so that one (or both) of the side edges 14 is positioned over a portion of either first print line roller 31 or second print line roller 32 having the smaller diameter $d_2$. This can create an undesirable unbalanced tension in receiver media 10, which can cause the receiver media 10 to drift, or even tear. FIG. 9 shows a side view of an adjustable print line roller 37 that can be used in some embodiments to address this problem. Adjustable print line roller 37 has an extended portion having the smaller diameter $d_2$ near one end and a sleeve 38 that can be repositioned along the length of the adjustable print line roller 37 (as indicated by the double headed arrow) to a position to support a side edge 14 (FIG. 8) of the receiver media 10 that would otherwise be unsupported. Sleeve 38 has an outer sleeve diameter $d_S$ substantially equal to the first diameter $d_1$. The inner diameter of sleeve 38 can be slightly larger than second diameter $d_2$ so that sleeve 38 can fit around the extended portion having the second diameter $d_2$. In various embodiments, the position of sleeve 38 can be fixed by press fitting, or by the use of a set screw or other such fixing device. This approach has the advantage that the adjustable print line roller 37 can be reconfigured for use with a wide variety of different receiver media widths. Any of the rollers with contoured surface profiles described herein (e.g., the print line rollers 31, 32 of FIG. 5) can be provided with adjustable sleeves 38 on one or both ends so that they can be adjusted to adapt to different widths of receiver media 10.

Figure 10:
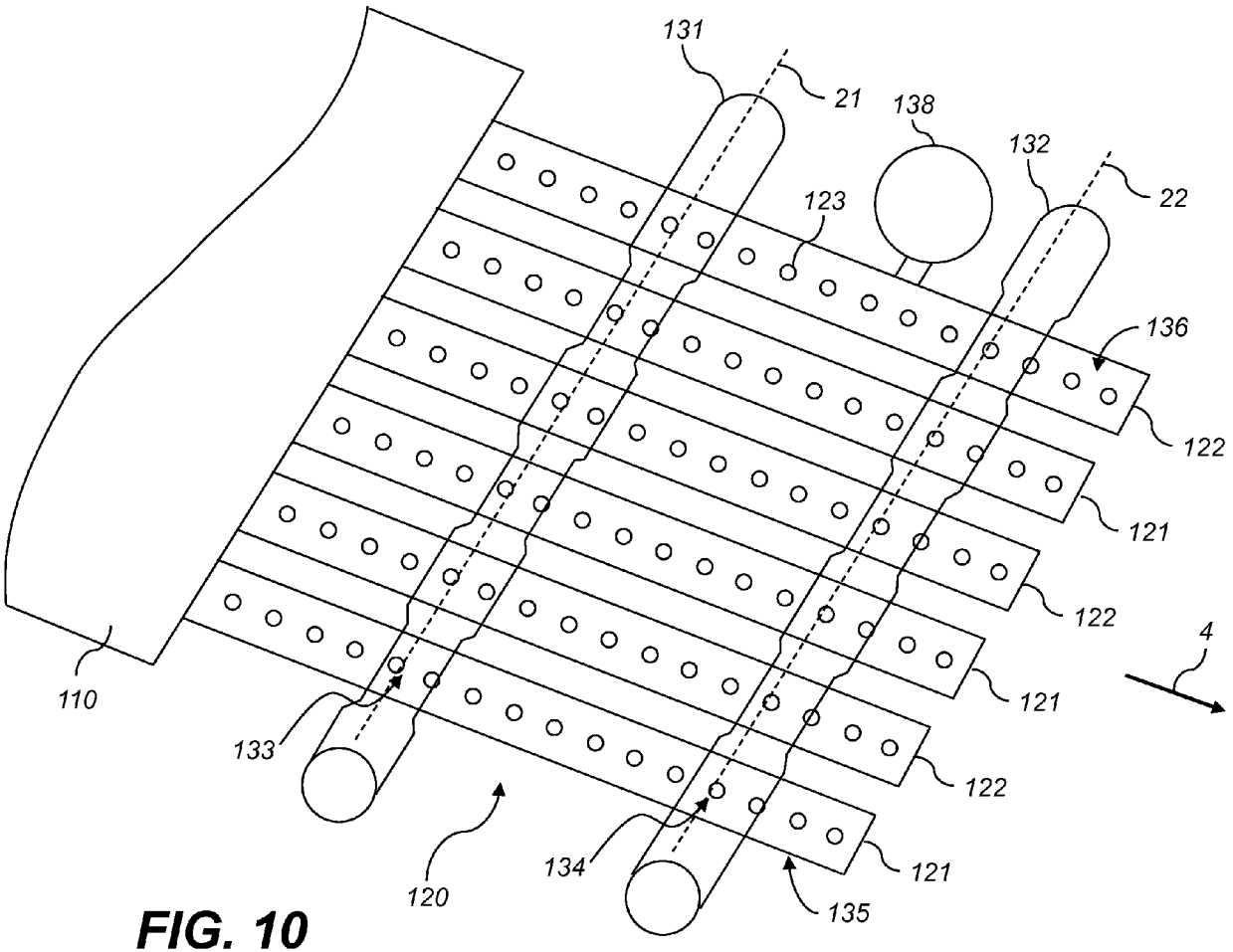
FIG. 10 is a perspective view showing first and second contoured media guide surfaces provided by first and second contoured print line rollers and a vacuum transport belt for transporting cut sheet media according to an embodiment.

FIG. 10 is a perspective of an alternate embodiment where first contoured media guide surface 133 and second contoured media guide surface 134 are provided by a vacuum transport belt 120 for cut sheet receiver media 110. In the illustrated embodiment, vacuum transport belt 120 (only a portion of which is shown) includes a plurality of first belt strips 121 and second belt strips 122 that are arranged side-by-side in an alternating fashion, and are supported by first contoured roller 131 and second contoured roller 132. The contoured rollers 131, 132 have similar shapes as the print line rollers 31, 32 described above relative to FIG. 5 for supporting receiver media 10. The first belt strips 121 are supported by portions of contoured rollers 131, 132, such that a first surface 135 of the first belt strips 121 contacts portions of first contoured roller 131 having the smaller diameter $d_2$ and contacts portions of second contoured roller 132 having the larger diameter $d_1$. Similarly, second belt strips 122 are supported by complementary portions of contoured rollers 131, 132, such that the first surface 135 of the second belt strips 122 contacts portions of first contoured roller 131 having the larger diameter $d_1$ and contacts portions of second contoured roller 132 having the smaller diameter $d_2$.

Figure 11A:
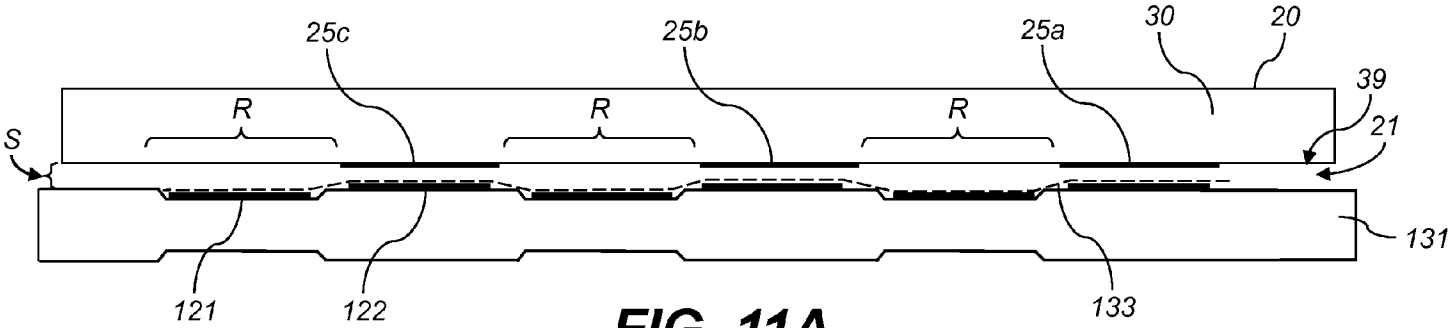
FIGS. 11A and 11B show cross-sectional views through the configuration of FIG. 10 along the first and second print lines, respectively.
Figure 11B:
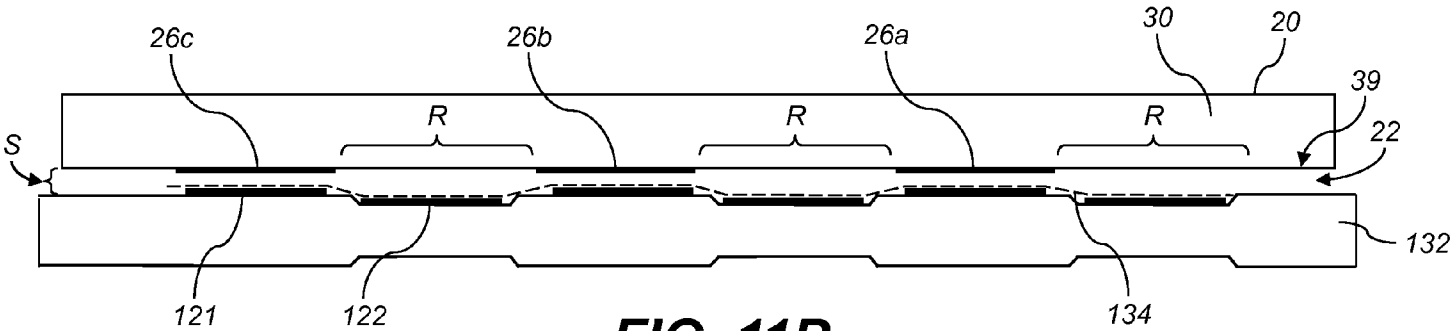

FIGS. 11A and 11B show cross-sectional views through the first contoured roller 131 and second contoured roller 132 of FIG. 10 along print lines 21 and 22, respectively. Second surfaces 136 (FIG. 10) of the first belt strips 121 and second belt strips 122 (i.e., the surface that faces away from the contoured rollers 131, 132 and face toward the printhead 20) provides a composite first contoured media guide surface 133 as they pass over the first contoured roller 131, which is contoured to be closer to the printhead 20 for portions of print lines 21 corresponding to inkjet nozzle arrays 25*a*, 25*b*, 25*c* than it is for at least some portion of the non-printing regions R. Similarly, the second surfaces 136 of the first belt strips 121 and second belt strips 122 provides a composite second contoured media guide surface 134 as they pass over the second contoured roller 132, which is contoured to be closer to the inkjet printhead 20 for portions of print lines 22 corresponding to inkjet nozzle arrays 26*a*, 26*b*, 26*c* than it is for at least some portion of the non-printing regions R.

Each belt strip 121, 122 includes a plurality of vacuum holes 123 through which vacuum from vacuum system 138 is applied to hold cut sheet receiver media 110 to the second surface 136 of the belt strips 121, 122 that face printhead 20. Regarded as a whole unit, vacuum transport belt 120 has a first surface 135 that contacts the contoured rollers 131, 132 and an opposing second surface 136 that faces printhead 20, such that vacuum transport belt 120 at least partially conforms to the surfaces of the contoured rollers 131, 132, and such that the contoured media guide surfaces 133,134 are provided by the second surface 136 of the belt strips 121, 122.

In other embodiments (not shown) a vacuum transport belt can be constructed of one continuous belt, rather than a plurality of adjacent belt strips, such that the one continuous belt at least partially conforms to the surfaces of contoured rollers 131, 132. The shape of cut sheet receiver media 110 supported by the vacuum transport belt 120 (whether formed using a plurality of belt strips 121, 122 or as a continuous belt) will have a similar shape as shown for receiver media 10 in FIG. 8.

Figure 12:
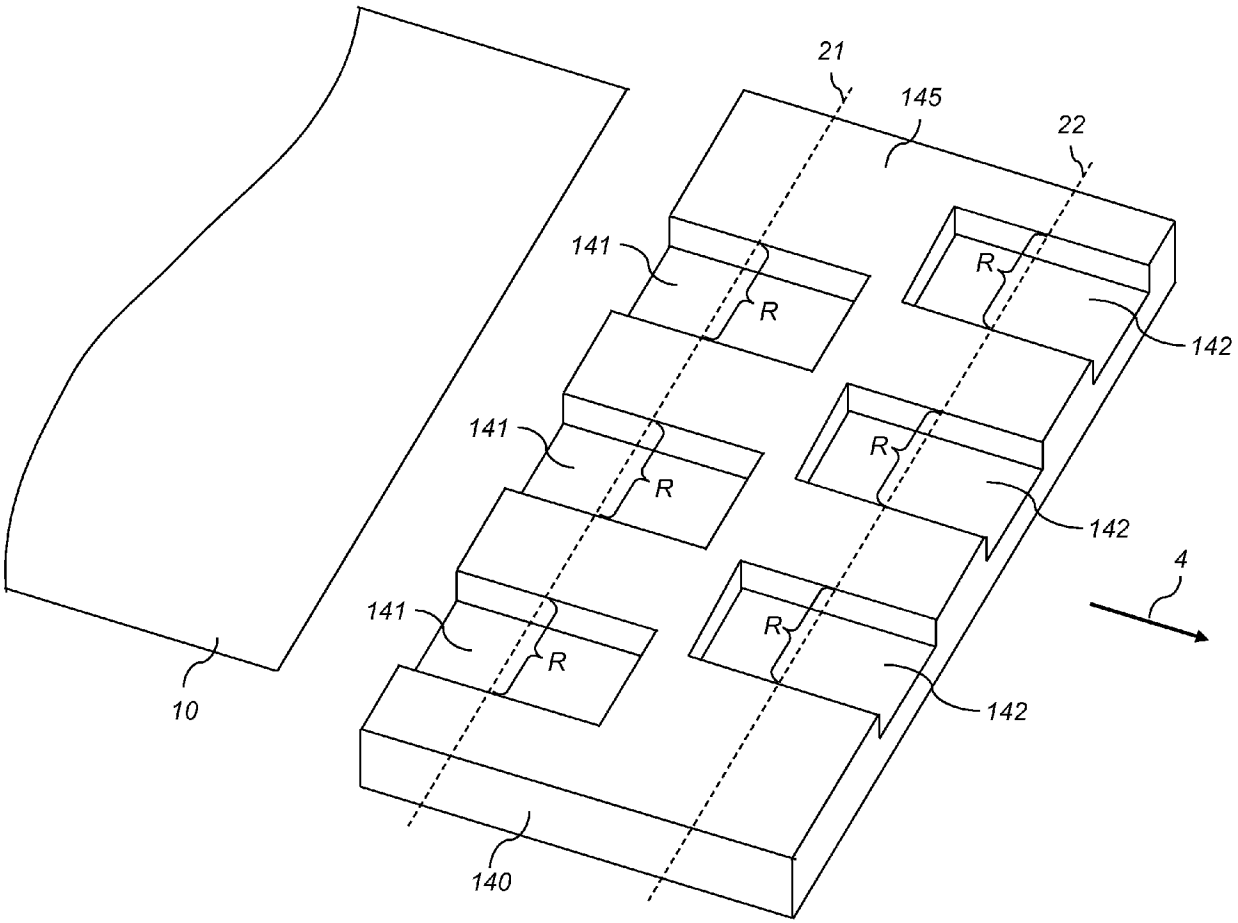
FIG. 12 is a perspective view of a contoured media guide surface provided by a fixed media support according to an embodiment of the invention.

FIG. 12 shows an alternate embodiment where the contoured media guide surfaces are provided by a fixed media support 140, rather than having moving rollers (as in FIG. 5) or belt(s) (as in FIG. 10). The fixed media support 140 has a contoured surface 145 facing printhead 20 (FIG. 4) that supports and guides receiver media 10 as it moves in the media advance direction 4. First depressions 141 in contoured surface 145 are aligned with non-printing regions R of first print line 21, and second depressions 142 in contoured surface 145 are aligned with non-printing regions R of second print line 22. Cross-sectional views of fixed media support 140 near printhead 20 along first print line 21 and second print line 22 would appear similar to FIGS. 7A and 7B, respectively.

With reference to the contoured media guides provided by rollers (FIG. 5), belt(s) (FIG. 10) or a fixed media support 140 (FIG. 12), contoured media guide surfaces are provided along both the first print line 21 and the second print line 22 are provided. In some embodiments, a contoured media guide surface is provided along only one of the print lines, and a flat media guide surface is provided along the other print line. With reference to FIG. 2, for the most upstream printhead 20*a*, a comparatively small portion of the entire ink to be deposited on receiver media 10 is ejected near first print line roller 31 (e.g. only about half of the cyan ink, and none of the magenta, yellow or black ink that will be deposited to form the image). The tendency for the receiver media to distort by fluting near the most upstream print line roller 31 in printing module 50 is lower than for the downstream print line rollers. Similarly, the tendency for condensation on support structure 30 (FIG. 3) is lower for the most upstream print line 21 of the most upstream printhead 20*a*. As a result, the need for contoured media support is less for the upstream media guide surfaces than for the downstream media guide surfaces. Accordingly, in some embodiments one or more of the media guide surfaces (typically a downstream media guide surface) is contoured as described above (e.g., using contoured rollers, belts or fixed media supports), and one or more of the media guide surfaces (typically an upstream media guide surface) is flat.

Figure 13:
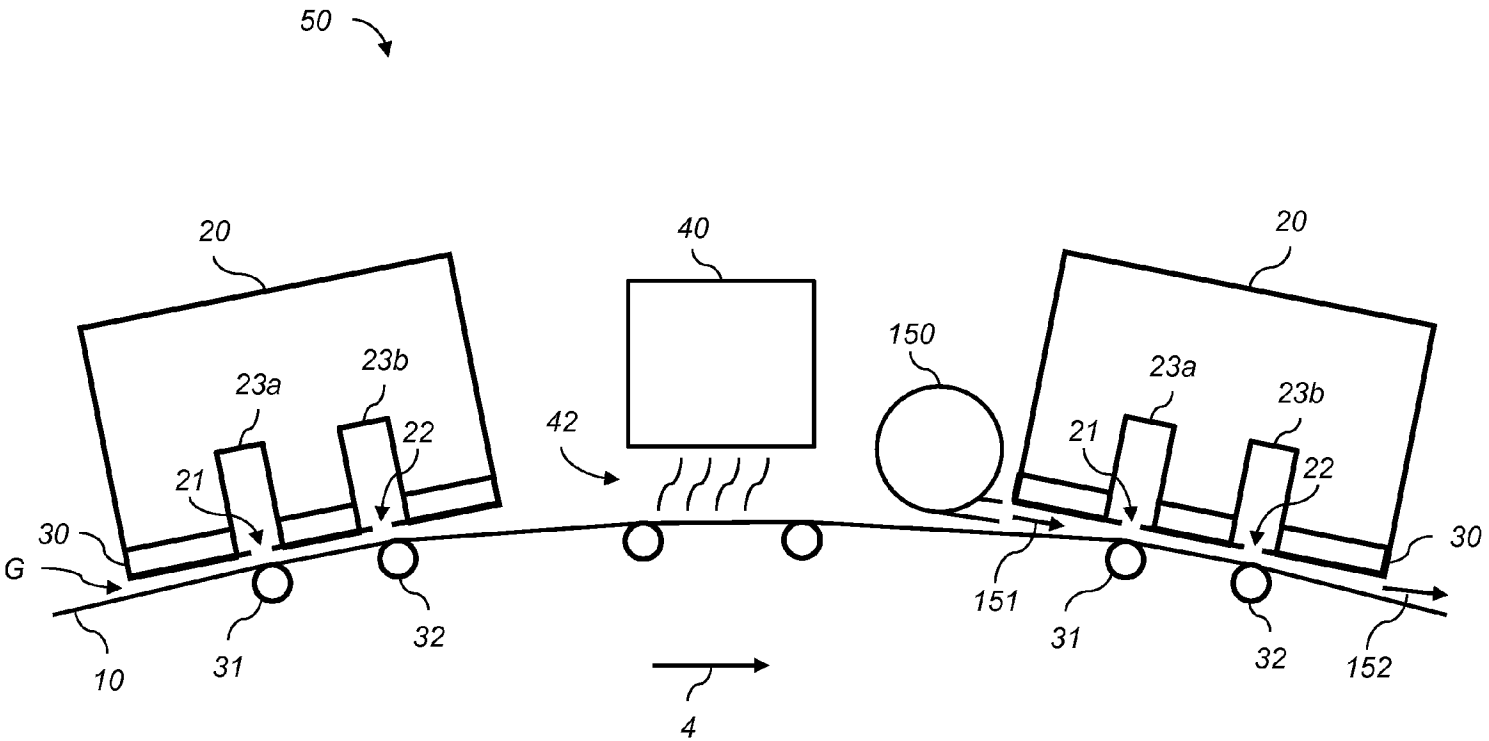
FIG. 13 shows an embodiment having a similar configuration as FIG. 3 further including a blower near the inkjet printhead.

Commonly-assigned U.S. patent application Ser. No. 13/721,126 entitled "Inkjet printing system with condensation control", which was filed Dec. 20, 2012 and is incorporated herein by reference in its entirety, discloses printing system configurations that can be used in combination with embodiments of the present invention for reducing the tendency for moisture condensed on the support structure 30 to be transferred to the adjacent receiver media (e.g., receiver media 10). As shown in FIG. 13, in some embodiments an air source such as blower 150 is provided near receiver media 10 and support structure 30 of a printhead 20, for example where continuous web enters the print region corresponding to printhead 20 as receiver media 10 is advanced in media advance direction 4. (FIG. 13 is analogous to FIG. 3, but with the addition of blower 150.) Air from blower 150 enters the region near printhead 20 as shown by entry arrow 151 and leaves the region near printhead 20 as shown by exit arrow 152. The less humid air from blower 150 helps to displace humid air between support structure 30 and receiver media 10, where the humidity in that region is otherwise increased by evaporation from printed ink droplets (enhanced for example by dryer 40 and drawn under the next printhead 20 by the moving receiver media 10).

An advantage of using a contoured media guide surface (e.g., provided by print line rollers 31, 32 having contoured media guide surfaces 33, 34 (FIG. 5)) is that improved airflow is enabled between receiver media 10 and support structure 30 because receiver media 10 sags away from support structure 30 in the non printing regions R (e.g., as shown in FIG. 8). With the improved airflow from blower 150, more of the humid air is displaced from around support structure 30, thereby providing a lower tendency for moisture to condense on it.

Figure 14:
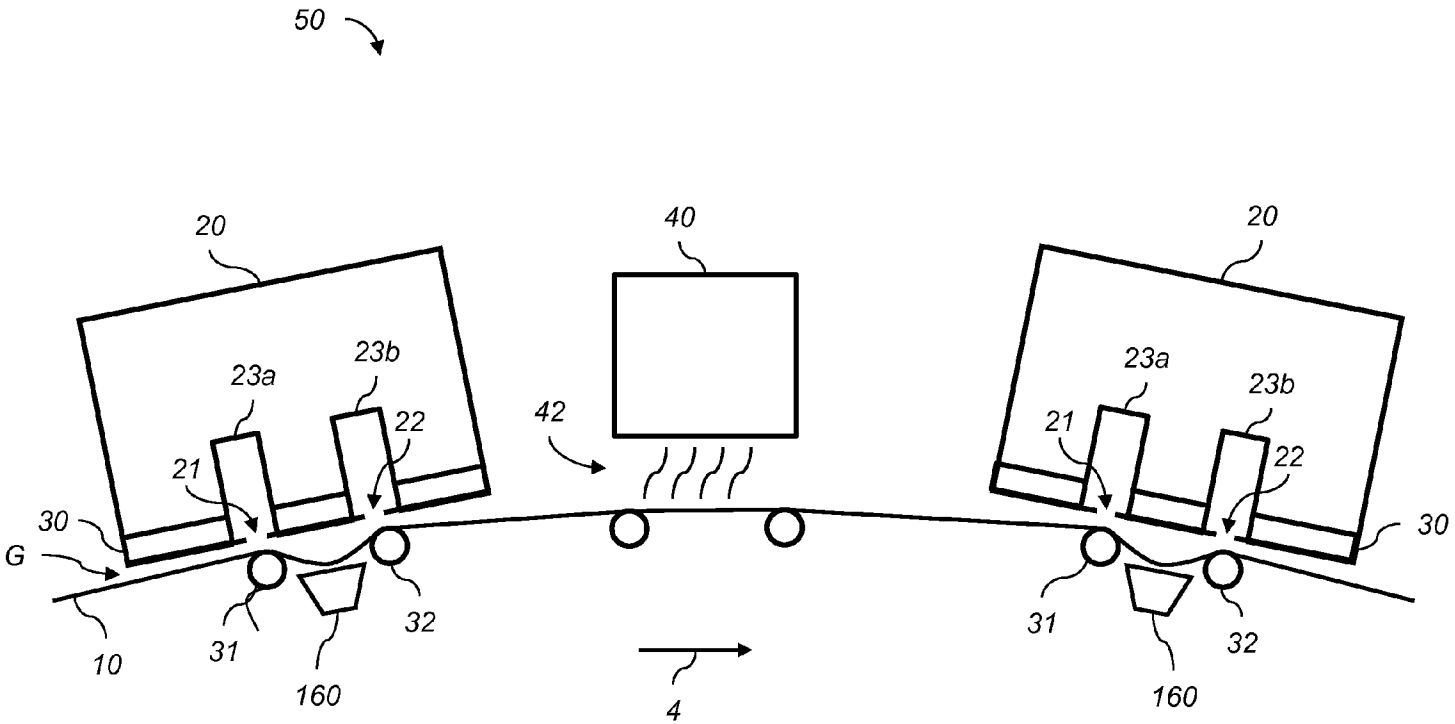
FIG. 14 shows an embodiment having a similar configuration as FIG. 3 further including vacuum systems to pull the receiver media away from the inkjet printheads between the first and second print line rollers.

Commonly-assigned U.S. patent application Ser. No. 13/483,356 entitled "Vacuum pull down of a print media in a printing system", which was filed May 30, 2012 and is incorporated herein by reference in its entirety, discloses a printing system configuration that can be used in combination with embodiments of the present invention. In particular, as shown in FIG. 14, a vacuum system 160 is disposed below the receiver media 10 between first print line 21 and second print line 22 for each of the printheads 20 that are shown. Vacuum system 160 pulls the receiver media 10 away from support structure 30 of printhead 20, so that there is less chance of any distortions in receiver media 10 striking the support structure 30. In addition, there is improved airflow between first print line roller 31 and second print line roller 32 so that humid air can be more easily displaced in order to inhibit condensation on support structure 30. In addition, comparing FIG. 14 (with the anti-strike vacuum systems 160) to FIG. 3 (without the anti-strike vacuum systems 160) it can be seen that vacuum systems 160 cause the receiver media 10 to wrap around the print line rollers 31, 32 to a greater extent. The resulting tension provided by vacuum system 160 draws the receiver media 10 toward the first contoured media guide surface 33 (FIG. 5) of the first print line roller 31 and the second contoured media guide surface 34 (FIG. 5) of the second print line roller 32. With reference to FIG. 8, this would cause the receiver media 10 in the non-printing regions R to be pulled down further in regions where the roller diameter is less. It is generally not desirable for the receiver media 10 to actually contact the print line rollers 31, 32 in the portions with the smaller diameter $d_2$, so for systems including anti-strike vacuum systems 160 it will generally be desirable to use a small enough diameter $d_2$ such that the receiver will not contact the print line rollers 31, 32 in the non-printing regions.

Figure 15:
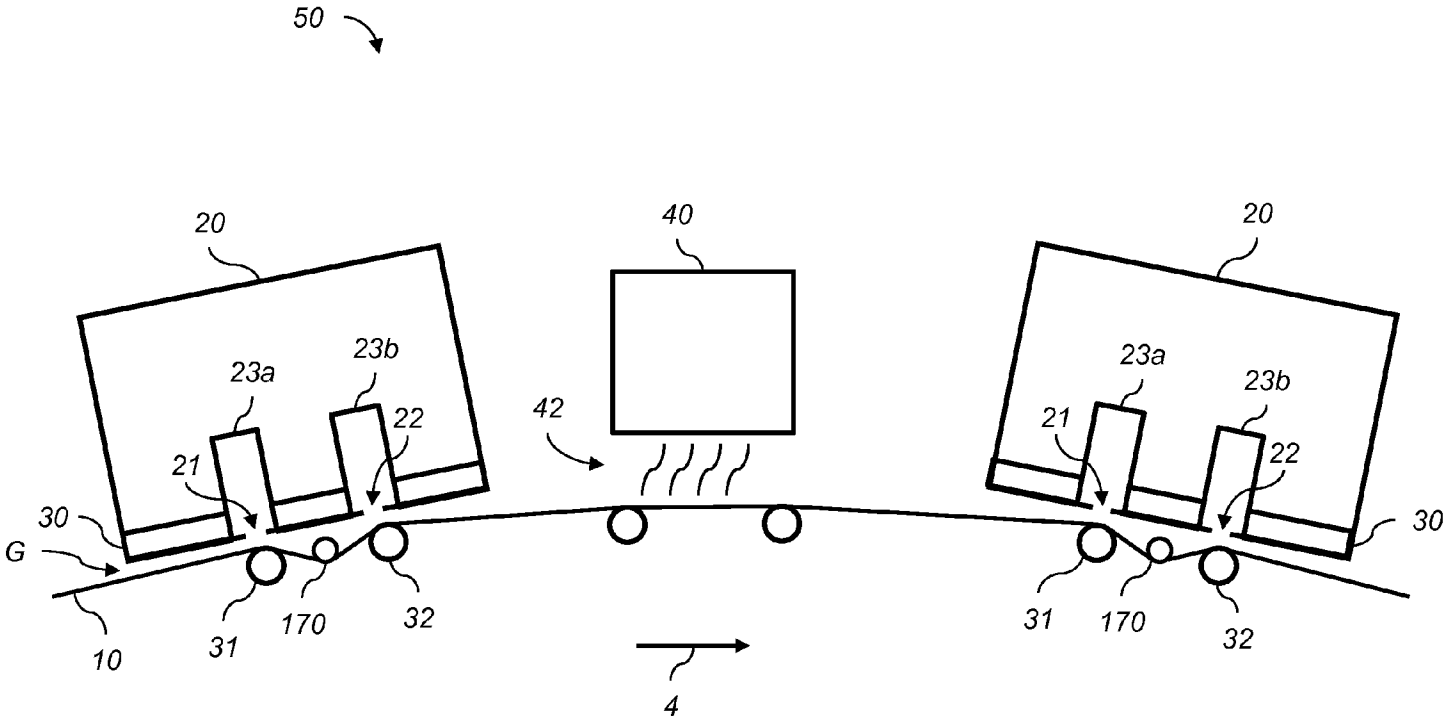
FIG. 15 shows an embodiment having a similar configuration as FIG. 3 further including contoured center rollers positioned between the first and second print line rollers configured to pull the receiver media away from the inkjet printheads.

An alternative to using an anti-strike vacuum system 160 described above with reference to FIG. 14 for pulling the receiver media 10 away from support structure 30 of printhead 20 and also for drawing the receiver media 10 toward the contoured media guide surfaces 33, 34 of print line rollers 31, 32 is to loop the receiver media 10 below a center roller 170 between first print line roller 31 and the second print line roller 32 as shown in FIG. 15. By "center" it is meant that center roller 170 is between the first print line roller 31 and the second print line roller 32, and is preferably about midway between them, and not necessarily that center roller 170 is equidistant from first print line roller 31 and the second print line roller 32.

Figure 16:
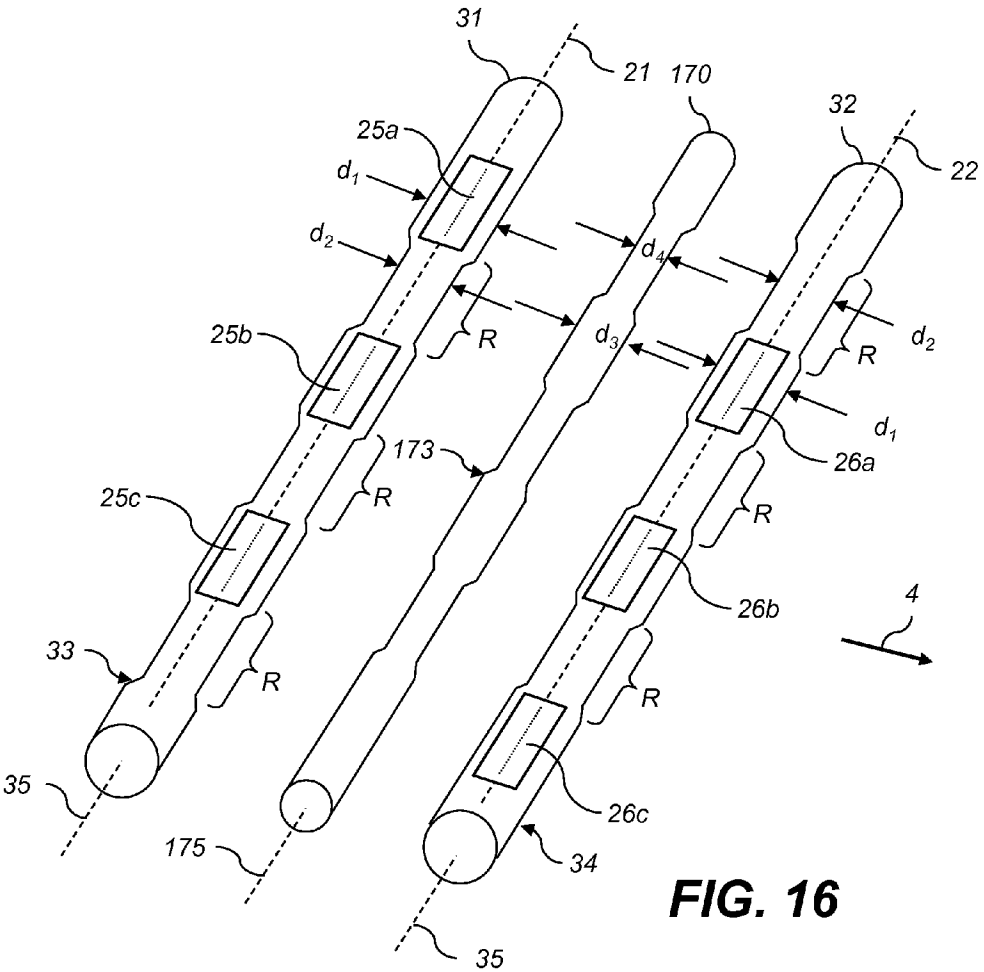
FIG. 16 is a perspective view showing a contoured center roller positioned between contoured first and second print line rollers.

Because the receiver media 10 has already been printed on by printhead modules 23*a* before the printed surface comes into contact with the bottom of center roller 170, it is advantageous for center roller 170 to be contoured to have a contoured media guide surface 173 as shown in FIG. 16. This configuration includes first print line roller 31 having first contoured media guide surface 33, second print line roller 32 having second contoured media guide surface 34, and center roller 170 having contoured media guide surface 173 with a corresponding contoured surface profile. The center roller 170 has an axis 175 that is substantially parallel to the axes 35 of the print line rollers 31, 32. The center roller 170 has a smaller diameter ($d_4$) for portions of its length corresponding to the inkjet nozzle arrays 25*a*, 25*b*, 25*c* along the first print line 21 and a larger diameter ($d_3$) for at least some portion of its length corresponding to the non-printing regions R along the first print line 21. In this way, contoured media guide surface 173 of center roller 170 does not contact portions of receiver media 10 that have ink deposited by the inkjet nozzle arrays 25*a*, 25*b*, 25*c* of the first print line 21. It can be seen that the contoured media guide surface 173 of center roller 170 is similar to the contoured media guide surface 34 of the second print line roller 32. In other words, the portions along the length of center roller 170 with the smaller diameter $d_4$ are located similarly to the portions along the length of second print line roller 32 with the smaller diameter $d_2$.

Figure 17:
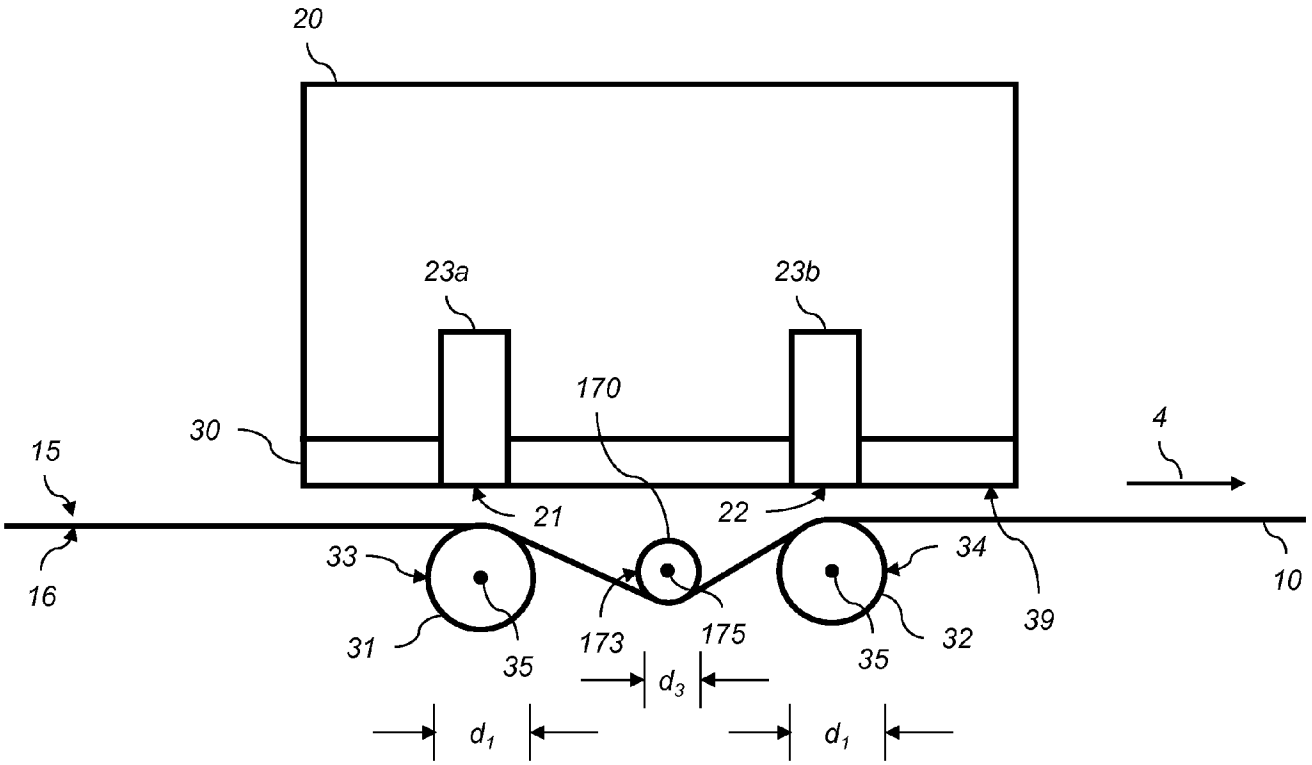
FIG. 17 is a close-up view of a portion of the printing module of FIG. 15.

A close-up view of receiver media 10 being advanced past first print line 21 and second print line 22 of staggered inkjet printhead 20 using print line rollers 31, 32 and center roller 170 is shown in FIG. 17. The receiver media 10 has a front surface 15 that faces printhead 20 and an opposing back surface 16. As the receiver media 10 is moved along the media path along media advance direction 4, the back surface 16 of the receiver media 10 contacts the first contoured media guide surface 33 of first print line roller 31 and the second contoured media guide surface 34 of second print line roller 32. The front surface 15 of the receiver media 10, having just been printed on by printhead module 23*a* along first print line 21, contacts the contoured media guide surface 173 of center roller 170. It has been found that if the contoured media guide surface 173 of the bottom of center roller 170 is too far displaced from the contoured media guide surfaces 33, 34 on the top of print line rollers 31, 32, too much tension can be applied to receiver media 10, causing it to tear. In order to apply less tension to receiver media 10, the maximum diameter $d_3$ of center roller 170 can be made to be smaller than the maximum diameter $d_1$ of the print line rollers 31, 32. In addition, the center roller 170 can be moved closer to support structure surface 39 of support structure 30 so that the bottom of center roller 170 is less displaced from the top of print line rollers 31, 32. In other words, relative to a plane defined by the first print line 21 and the second print line 22 (that plane being coincident with support structure surface 39 in FIG. 17) a distance between axis 175 of center roller 170 and the plane is less than both a distance between axis 35 of the first print line roller 31 and the plane and a distance between axis 35 of the second print line roller 32 and the plane. This reduces the wrap angle of the receiver media 10 around the rollers, and thereby reduces the tension.

In the embodiment discussed with reference to FIGS. 16 and 17, both the center roller 170, as well as the print line rollers 31, 32 have contoured surface profiles provided by varying the diameter of the rollers along their length. However, in some embodiments one or more of the rollers may have a constant diameter. For example, in some configurations, one or both of the print line rollers 31, 32 can have a constant diameter to provide a corresponding flat media guide surface. In some embodiments, the center roller 170 can be provided with a sleeve 38 (FIG. 9) on one or both ends so that the center roller 170 can be adjusted to adapt to different widths of receiver media 10.

Figure 18:
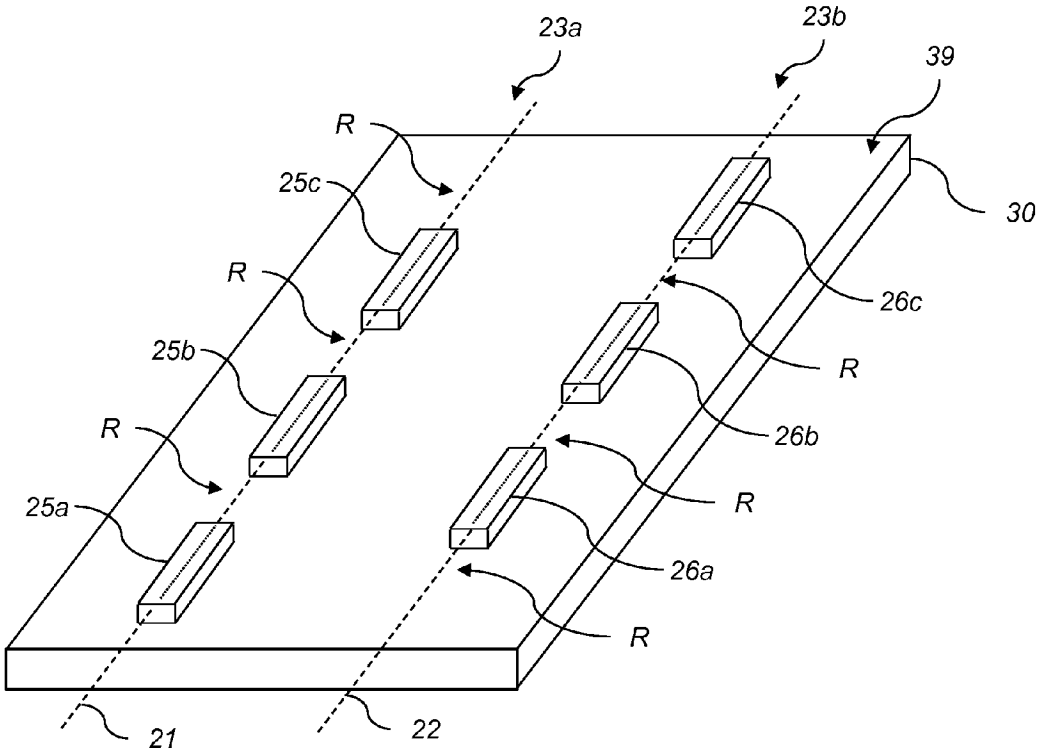
FIG. 18 is a perspective view of a printhead support structure having a surface that is recessed relative to the inkjet nozzle arrays in non-printing regions.

With reference to FIG. 4, in some embodiments the inkjet nozzle arrays 25*a*, 25*b*, 25*c* in printhead module 23*a* and the inkjet nozzle arrays 26*a*, 26*b*, 26*c* in printhead module 23*b* are substantially flush with the support structure surface 39 that faces the receiver media 10 (FIG. 3). FIG. 18 illustrates an alternate embodiment where portions of the support structure surface 39 are recessed relative to the inkjet nozzle arrays 25*a*, 25*b*, 25*c*, 26*a*, 26*b*, 26*c*. In particular, it can be advantageous for support structure surface 39 of support structure 30 to be recessed relative to inkjet nozzle arrays 25*a*, 25*b*, 25*c*, 26*a*, 26*b*, 26*c* in at least some regions corresponding to non-printing regions R along at least one of the print lines 21, 22, thereby increases the gap between support structure surface 39 and the receiver media 10. This further promotes greater airflow for reducing humidity, and also reduces the likelihood that the receiver media 10 will strike support structure surface 39.

Figure 19:
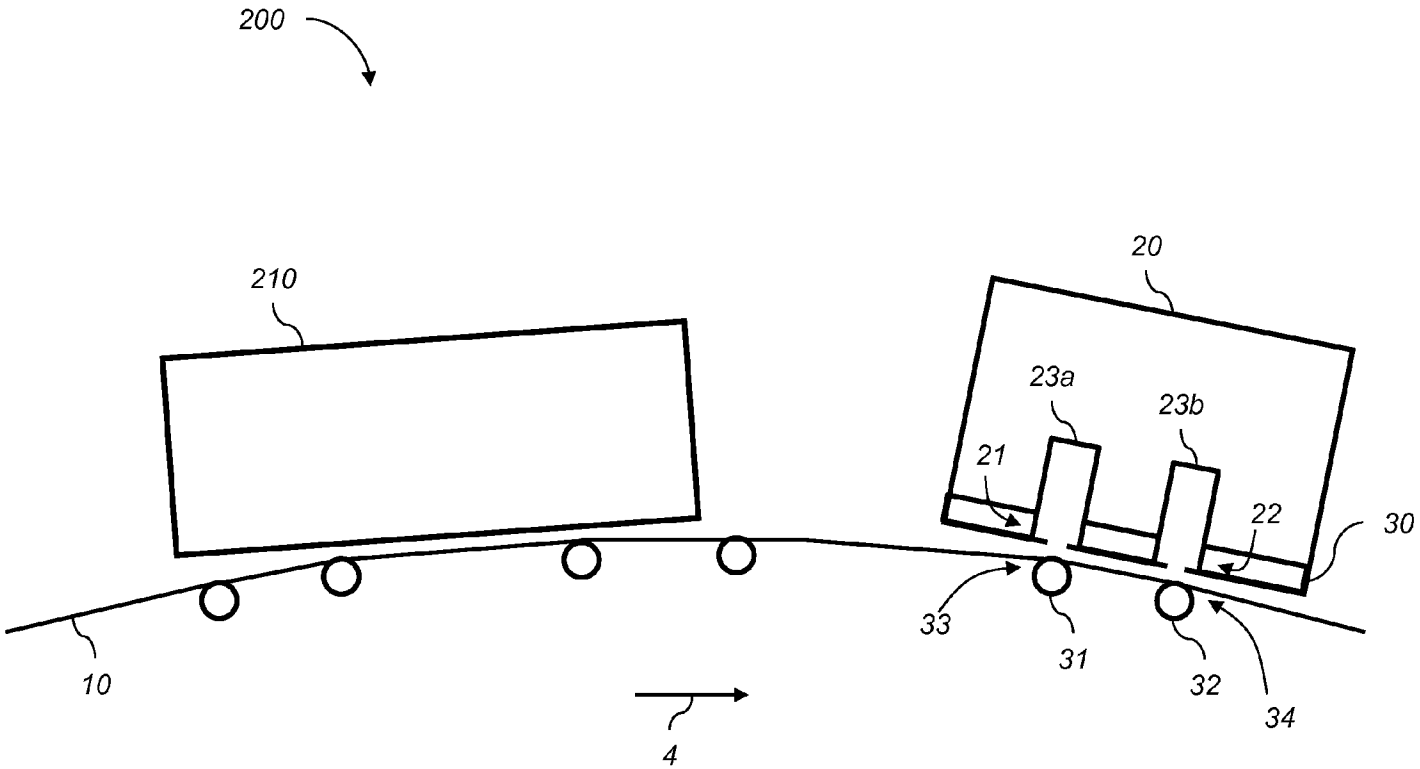
FIG. 19 is a simplified side view of a printing system that includes both a non-inkjet printing portion as well as an inkjet printing portion that includes contoured media guide surfaces in accordance with the present invention.

In the embodiments described above only inkjet printheads 20 are shown for printing on the continuous web of receiver media 10 or cut sheet receiver media 110. In some printing systems inkjet printheads 20 can be used in combination with non-inkjet printing technologies such as offset printing or electrophotography. For example, the inkjet printheads 20 can be used for adding variable content such as annotations or for providing spot color. FIG. 19 shows a printing system 200 having both a non-inkjet printing module 210, as well as an inkjet printhead 20. Receiver media 10 is advanced past both the non-inkjet printing module 210 and the inkjet printhead 20 along a media path in a media advance direction 4 for printing. In accordance with the present invention, contoured media guide surfaces 33, 34 near print lines 21, 22 of inkjet printhead 20, are provided, for example by print line rollers 31, 32, or by contoured belt(s) or by contoured fixed media supports as described above.

The invention has been described in detail with particular reference to certain preferred embodiments thereof, but it will be understood that variations and modifications can be effected within the spirit and scope of the invention.

PARTS LIST

2 roller
3 receiver media
4 media advance direction
5 flute
6 nozzle array direction
7 cross-track direction
8 contact surface
10 receiver media
11 source roll
12 take-up roll
14 side edge
15 front surface
16 back surface
20, 20*a*, 20*b*, 20*c*, 20*d* printhead
21 print line
22 print line
23*a*, 23*b* printhead module
24 nozzle
25, 25*a*, 25*b*, 25*c* inkjet nozzle array
26, 26*a*, 26*b*, 26*c* inkjet nozzle array
30 support structure
31 print line roller
32 print line roller
33 contoured media guide surface
34 contoured media guide surface
35 axis
36 transition portion
37 adjustable print line roller
38 sleeve
39 support structure surface
40 dryer
41 dryer roller
42 heat
45 quality control sensor
50 printing module
51 first zone
52 second zone
100 printing system
110 cut sheet receiver media
120 vacuum transport belt
121 belt strips
122 belt strips
123 vacuum holes
131 contoured roller
132 contoured roller
133 contoured media guide surface
134 contoured media guide surface
135 first surface
136 second surface
138 vacuum system
140 fixed media support
141 first depressions
142 second depressions
145 contoured surface
150 blower
151 entry arrow
152 exit arrow
160 vacuum system
170 center roller
173 contoured media guide surface
175 axis
200 printing system
210 non-inkjet printing module
$d_1$ diameter
$d_2$ diameter
$d_3$ diameter
$d_4$ diameter
$d_S$ sleeve diameter
G clearance gap
R non printing region
S spacing
V overlap region
W separation distance

The invention claimed is:

1. A printing system comprising:

a staggered inkjet printhead including at least two inkjet nozzle arrays arranged along first and second print lines in an alternating pattern, the first and second print lines being substantially parallel to each other and separated from each other along a media advance direction, each inkjet nozzle array including a corresponding group of nozzles extending along the corresponding print line in a nozzle array direction, the nozzles being adapted to eject drops of ink onto a receiver media which is moved along a media path past the first print line and then past the second print line, wherein the inkjet nozzle arrays along a particular print line alternate with non-printing regions, the positions of the inkjet nozzles arrays along the first and second print lines being offset from each other such that the non-printing regions along one of the print lines are aligned with the inkjet nozzle arrays along the other of the print lines; and a media guide including:

a first media guide surface for guiding the recording media along the media path past the first print line of the staggered inkjet printhead; and a second media guide surface for guiding the recording media along the media path past the second print line of the staggered inkjet printhead;

wherein at least one of the media guide surfaces is contoured such that it is closer to the staggered inkjet printhead along portions of the associated print line that correspond to the associated inkjet nozzle arrays than it is for at least some portion of the associated print line that corresponds to the non-printing regions.

2. The printing system of claim 1 wherein both the first and second media guide surfaces are contoured.

3. The printing system of claim 1 wherein at least one of the media guide surfaces is provided using a roller having an axis that is substantially parallel to the associated print line, and wherein a diameter of the roller varies along the length of the roller.

4. The printing system of claim 3 wherein the diameter of the roller is larger for portions of the roller that are aligned with the associated inkjet nozzle arrays than it is for at least some portion of the roller that is aligned with the non-printing regions.

5. The printing system of claim 4 wherein the roller has a first diameter for portions of the roller that are aligned with the associated inkjet nozzle arrays and has a second diameter for at least some portion of the roller that is aligned with the non-printing regions, the second diameter being smaller than the first diameter.

6. The printing system of claim 5 wherein the diameter of the roller is gradually tapered from the first diameter to the second diameter.

7. The printing system of claim 5 wherein side edges of the receiver media are supported by portions of the roller having the first diameter.

8. The printing system of claim 7 wherein the roller includes a sleeve having an outer diameter substantially equal to the first diameter, the sleeve being repositionable along a length of the roller such that the sleeve can be moved to a position corresponding to a side edge of the receiver media in order to adapt to different receiver media widths.

9. The printing system of claim 3 wherein the contoured media guide surface is the surface of the roller.

10. The printing system of claim 3 further including a belt supported by the roller, the belt having a first surface that contacts the roller and an opposing second surface that faces the staggered inkjet printhead, wherein the belt at least partially conforms to the surface of the roller, and wherein the contoured media guide surface is the second surface of the belt.

11. The printing system of claim 3 further including a plurality of belt strips supported by the roller, the belt strips having a first surface that contacts the roller and an opposing second surface that faces the inkjet printhead, wherein the contoured media guide surface is provided by the second surface of the belt strips.

12. The printing system of claim 1 wherein at least one of the media guide surfaces is provided by a fixed media support having a surface facing the inkjet printhead that provides the contoured media guide surface.

13. The printing system of claim 1 further including a vacuum system adapted to draw the receiver media away from the inkjet printhead and toward the first and second media guide surfaces.

14. The printing system of claim 1 wherein the staggered inkjet printhead further includes a support structure for supporting the inkjet nozzle arrays.

15. The printing system of claim 14 further including an air source for blowing air between the support structure of the staggered inkjet printhead and the receiver media.

16. The printing system of claim 14 wherein a surface of the support structure is recessed in at least some regions corresponding to non-printing regions along at least one of the print lines.

17. The printing system of claim 1 wherein the nozzles are adapted to eject drops of ink by a continuous inkjet process.

18. The printing system of claim 1 wherein the nozzles are adapted to eject drops of ink by a drop-on-demand inkjet process.

* * * * *